US010343756B2

(12) United States Patent
Vance, Jr.

(10) Patent No.: US 10,343,756 B2
(45) Date of Patent: Jul. 9, 2019

(54) OUTBOARD ENGINE KICK-UP JACKING PLATE

(71) Applicant: David E Vance, Jr., Taft, TN (US)

(72) Inventor: David E Vance, Jr., Taft, TN (US)

( * ) Notice: Subject to any disclaimer, the term of this patent is extended or adjusted under 35 U.S.C. 154(b) by 0 days.

(21) Appl. No.: 15/985,678

(22) Filed: May 21, 2018

(65) Prior Publication Data

US 2018/0334233 A1 Nov. 22, 2018

Related U.S. Application Data

(60) Provisional application No. 62/509,451, filed on May 22, 2017.

(51) Int. Cl.
*B63H 20/10* (2006.01)
*B63H 20/06* (2006.01)

(52) U.S. Cl.
CPC ..... *B63H 20/106* (2013.01); *B63H 20/06* (2013.01); *B63H 2020/103* (2013.01)

(58) Field of Classification Search
CPC . B63H 2020/103; B63H 20/106; B63H 20/06
See application file for complete search history.

(56) References Cited

U.S. PATENT DOCUMENTS 5,782,662 A * 7/1998 Icenogle ..... B63H 20/106 248/641
6,409,556 B1 * 6/2002 Vance ..... B63H 20/106 248/640
6,923,136 B1 * 8/2005 D'Alessandro ..... B63H 20/08 114/285
7,416,459 B1 * 8/2008 Pelini ..... B63H 20/106 440/61 R
7,527,539 B1 * 5/2009 Pelini ..... B63H 20/08 440/61 R
8,535,105 B1 * 9/2013 Pelini ..... B63H 20/02 440/61 E

* cited by examiner

*Primary Examiner* — S. Joseph Morano
*Assistant Examiner* — Jovon E Hayes
(74) *Attorney, Agent, or Firm* — Pitchford Fugett, PLLC; Mark A. Pitchford; Eric B. Fugett

(57) ABSTRACT

An integrated jack plate and kick up bracket is provided that is useful and safe even at relatively high boat speeds (e.g., in excess of 10 miles per hour). The bracket uses a jack plate to raise and lower an outboard. The jack plate is hingedly connected to the boat transom such that the jack plate assembly can rotate if the outboard has not been raised high enough to clear a submerged obstacle which the lower unit of the outboard motor strikes. Rotation of the jack assembly about the hinge is limited by a limiting strap affixed to the transom (or transom mounted portion of the bracket) and a lower portion of the jack assembly.

20 Claims, 11 Drawing Sheets

OUTBOARD ENGINE KICK-UP JACKING PLATE

CROSS-REFERENCES TO RELATED APPLICATIONS

The application claims priority to and hereby incorporates by reference in its entirety U.S. Provisional Patent Application Ser. No. 62/509,541 entitled "Outboard Engine Kick-Up Jacking Plate" filed on May 22, 2017.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to outboard engine mounting brackets. More particularly, this invention pertains to jack plates or jacking plates.

Marine outboard motors (i.e., outboard motors, outboard engines, or outboards) are typically fixed with respect to the transom of a boat. The outboard motor is bolted through holes in the transom or clamped onto the transom via a clamp integral with the outboard motor. Some outboard motors have manual or electric adjustable trim to improve performance of the motor and boat hull combination during varying operating conditions (i.e., speed, hull weight, water conditions, etc.). Jack plates are used with some outboard motors to further improve performance. A jack plate mounts to the boat transom and the outboard motor mounts to the jack plate. The jack plate is used to raise or lower the outboard motor relative to the transom in order to optimize the performance of the outboard motor and hull combination based on varying operating conditions. Additionally, anglers use jack plates to reduce the overall draft of a boat in order to enter and fish very shallow waters while protecting the propeller (i.e., prop) from damage due to contacting the bottom of the waterway or submerged debris. However, if underwater debris, or the bottom is contacted, the prop will be held in fixed relation to the transom and is likely to sustain damage.

Outboard motors and props (i.e., propellers) are susceptible to damage when contacting objects in the water while the boat is under way. Because the outboard motor is mounted to the transom at a fixed angle (generally parallel), striking an underwater object will damage the outboard, prop, and/or transom and hull. In order for hunters and anglers to enter shallow water which is likely to have debris (i.e., submerged stumps, logs, or other objects), kick up plates were developed. Kick up plates allow the outboard to swing up (i.e., increase the angle between the transom and the outboard) in order for the lower unit of the outboard and the prop to rise up over the underwater obstruction, reducing or limiting damage to the outboard, prop, and boat hull. Kick up plates rely on either a spring to bias the engine toward the down (generally parallel to the transom) position or a sheering member which breaks off when a submerged object produced a rearward force on the lower unit of the outboard. Both are insufficient for higher speed operation of boats because they allow the outboard to travel over 90 degrees, potentially putting the prop in contact with a boater operating the outboard via tiller. Additionally, any contact with submerged objects generally requires parts on the kick up plate to be replaced (e.g., sheer pins, springs, etc.).

BRIEF SUMMARY OF THE INVENTION

Aspects of the present invention provide an integrated jack plate and kick up bracket that is useful and safe even at relatively high boat speeds (e.g., in excess of 10 miles per hour). The bracket uses a jack plate to raise and lower an outboard. The jack plate is hingedly connected to the boat transom such that the jack plate assembly can rotate if the outboard has not been raised high enough to clear a submerged obstacle which the lower unit of the outboard motor strikes. Rotation of the jack assembly about the hinge is limited by a limiting strap affixed to the transom (or transom mounted portion of the bracket) and a lower portion of the jack assembly.

In one aspect, an outboard motor mounting bracket includes a hull mount, the motor plate, a jack assembly, and a limiting strap. The hull mount is configured to mount to a boat hull. The hull mount has an upper attachment point and a lower attachment point. The motor plate is configured to support an outboard motor. The jack assembly has an upper attachment point and a lower attachment point. The upper attachment point of the jack assemblies configured to hingedly engage the upper attachment point of the hull mount. The jack assemblies configured to support the motor plate and selectively adjust a vertical offset of the motor plate relative to the jack assembly or hull mount. The limiting strap is configured to connect the lower attachment point of the hull mount to the lower attachment point of the jack assembly such that a distance between the lower attachment point of the hull mount in the lower attachment point of the jack assembly is limited to a length of the limiting strap.

In another aspect, a boat includes a boat hull and an outboard motor mounting bracket. The outboard motor mounting bracket includes a hull mount, the motor plate, a jack assembly, and a limiting strap. The hull mount is configured to mount to a boat hull. The hull mount has an upper attachment point and a lower attachment point. The motor plate is configured to support an outboard motor. The jack assembly has an upper attachment point and a lower attachment point. The upper attachment point of the jack assemblies configured to hingedly engage the upper attachment point of the hull mount. The jack assemblies configured to support the motor plate and selectively adjust a vertical offset of the motor plate relative to the jack assembly or hull mount. The limiting strap is configured to connect the lower attachment point of the hull mount to the lower attachment point of the jack assembly such that a distance between the lower attachment point of the hull mount in the lower attachment point of the jack assembly is limited to a length of the limiting strap.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. As used herein, the upright position of an outboard motor mounting bracket is seen when the bracket is attached to a boat transom, the transom is generally vertical, and the boat is generally level. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Figure 1:
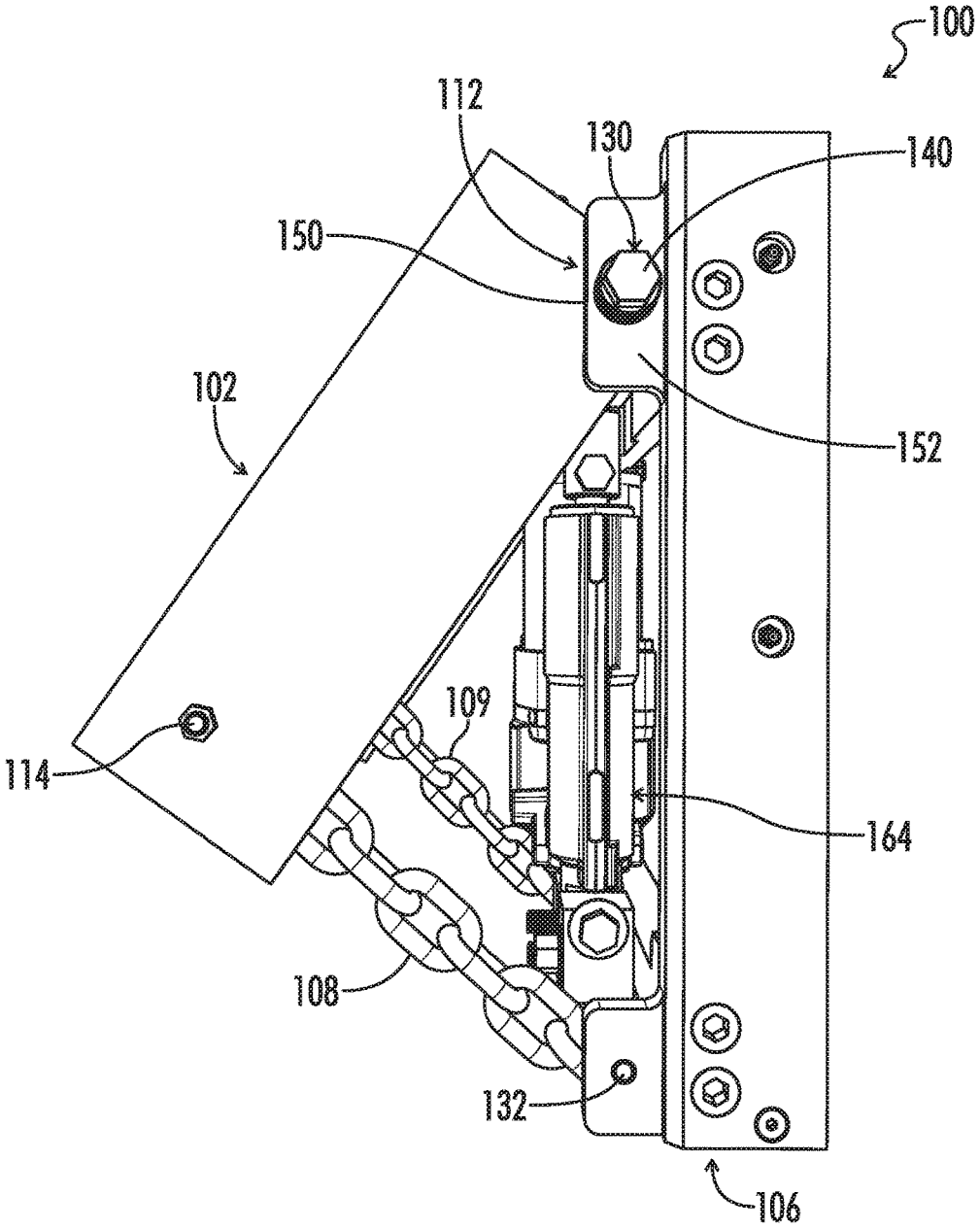
FIG. 1 is a port side view of an outboard mounting bracket in an open position according to one embodiment of the invention.
Figure 2:
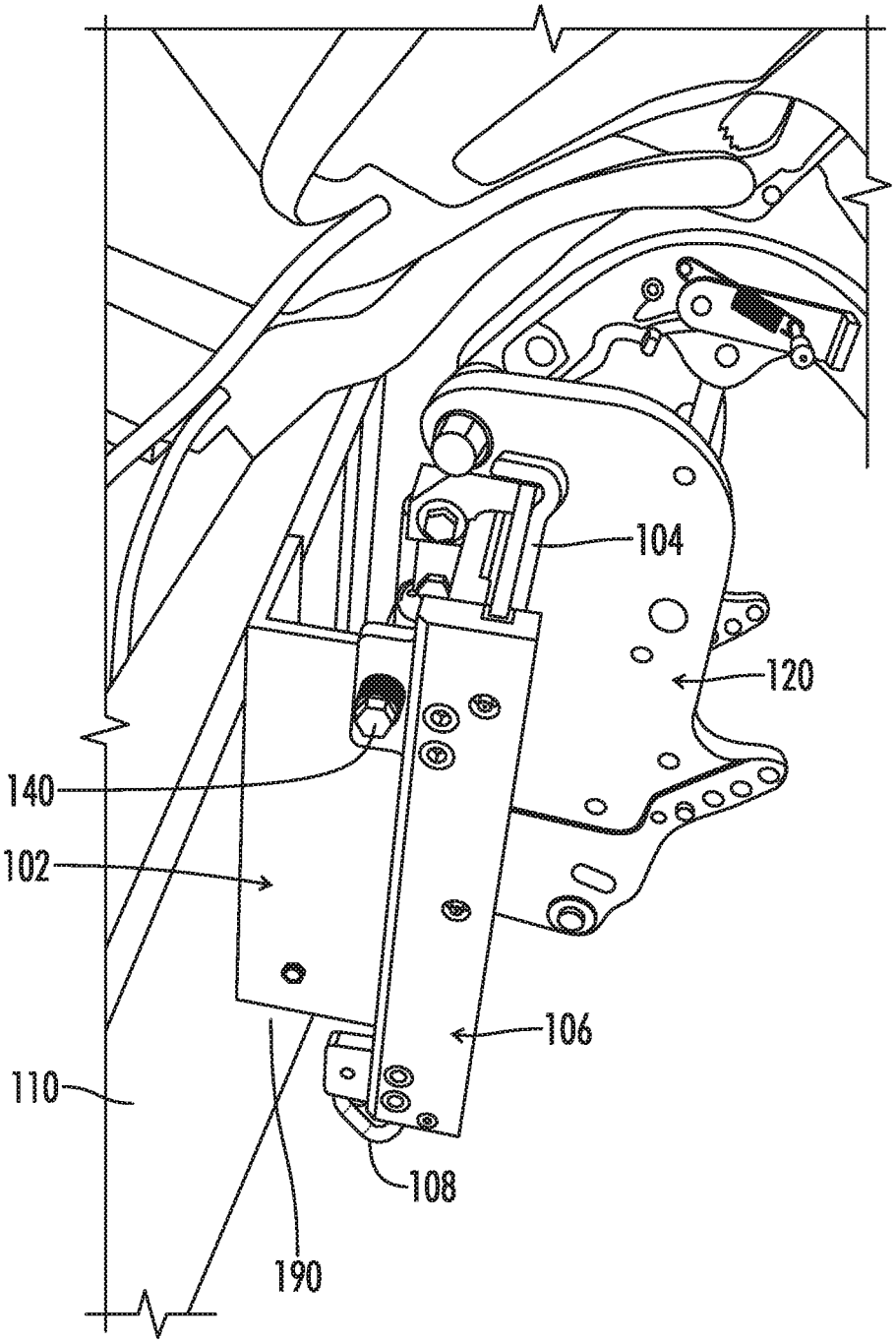
FIG. 2 is a port side isometric view of the outboard mounting bracket of FIG. 1 in an upright, closed position.
Figure 3:
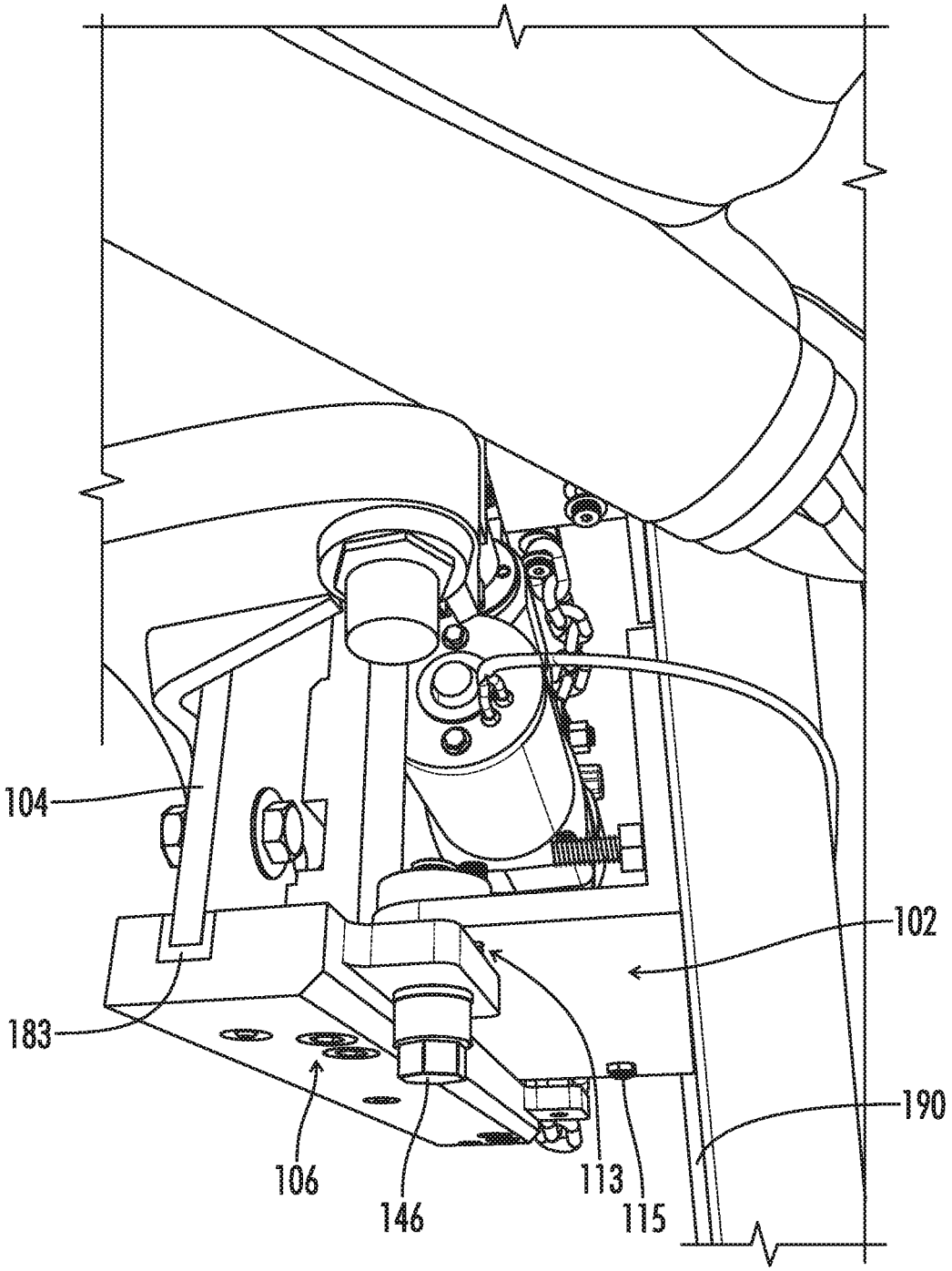
FIG. 3 is a top isometric view of a starboard side of the outboard mounting bracket of FIG. 1.
Figure 4:
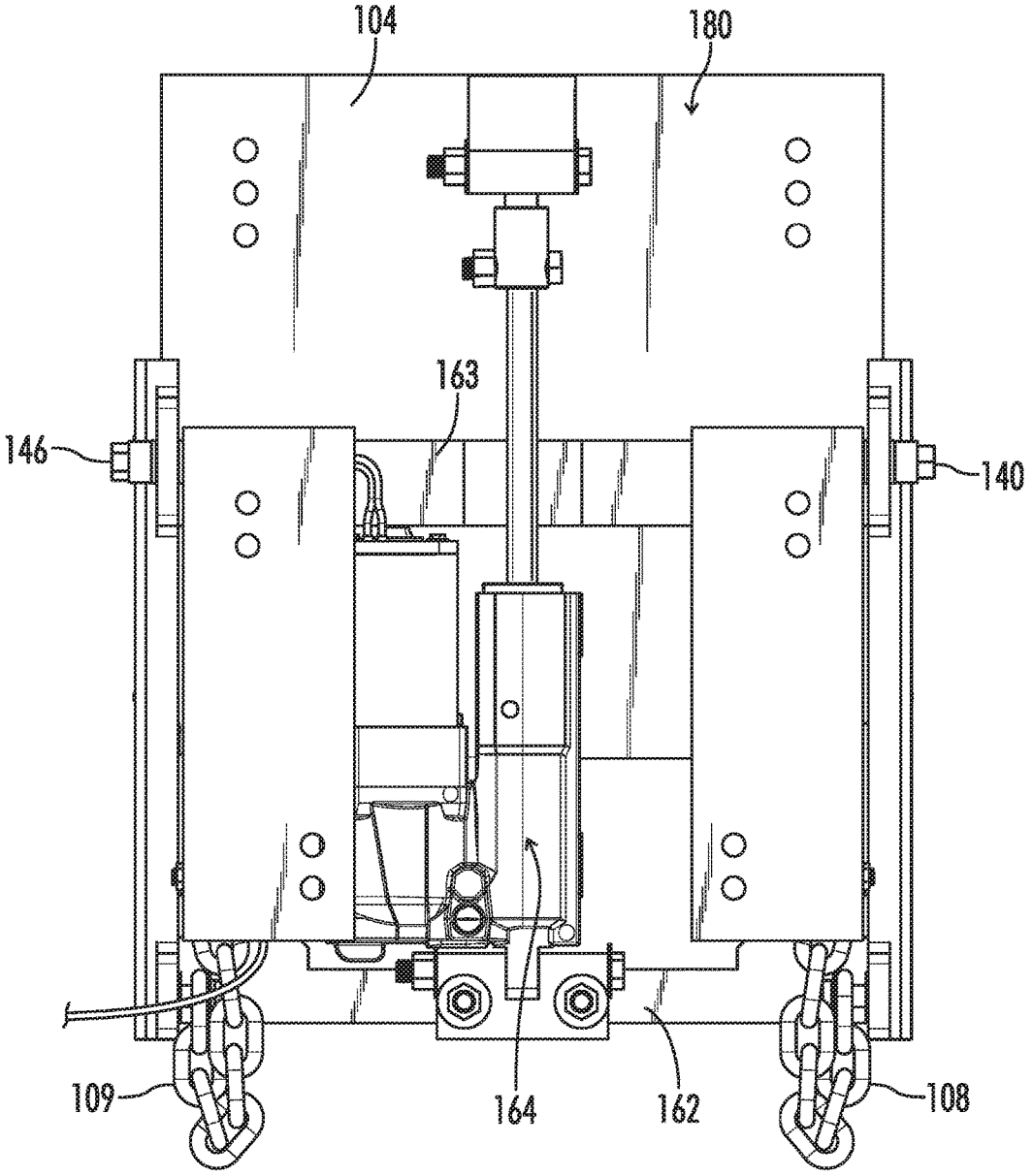
FIG. 4 is a front perspective view of the outboard mounting bracket of FIG. 1 with a motor plate in a raised or extended and closed position.
Figure 5:
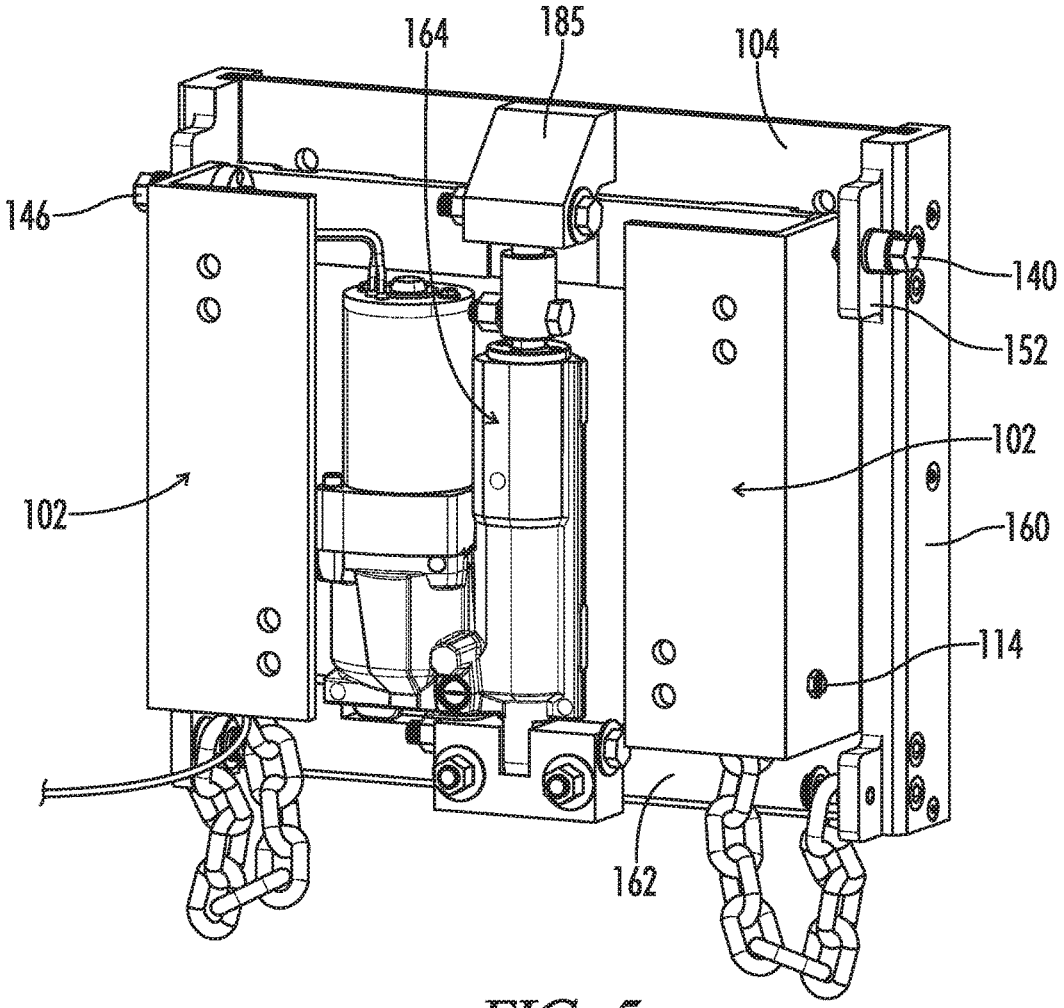
FIG. 5 is a port side front isometric view of the outboard mounting bracket of FIG. 1 in a retracted or lowered and closed position.
Figure 6:
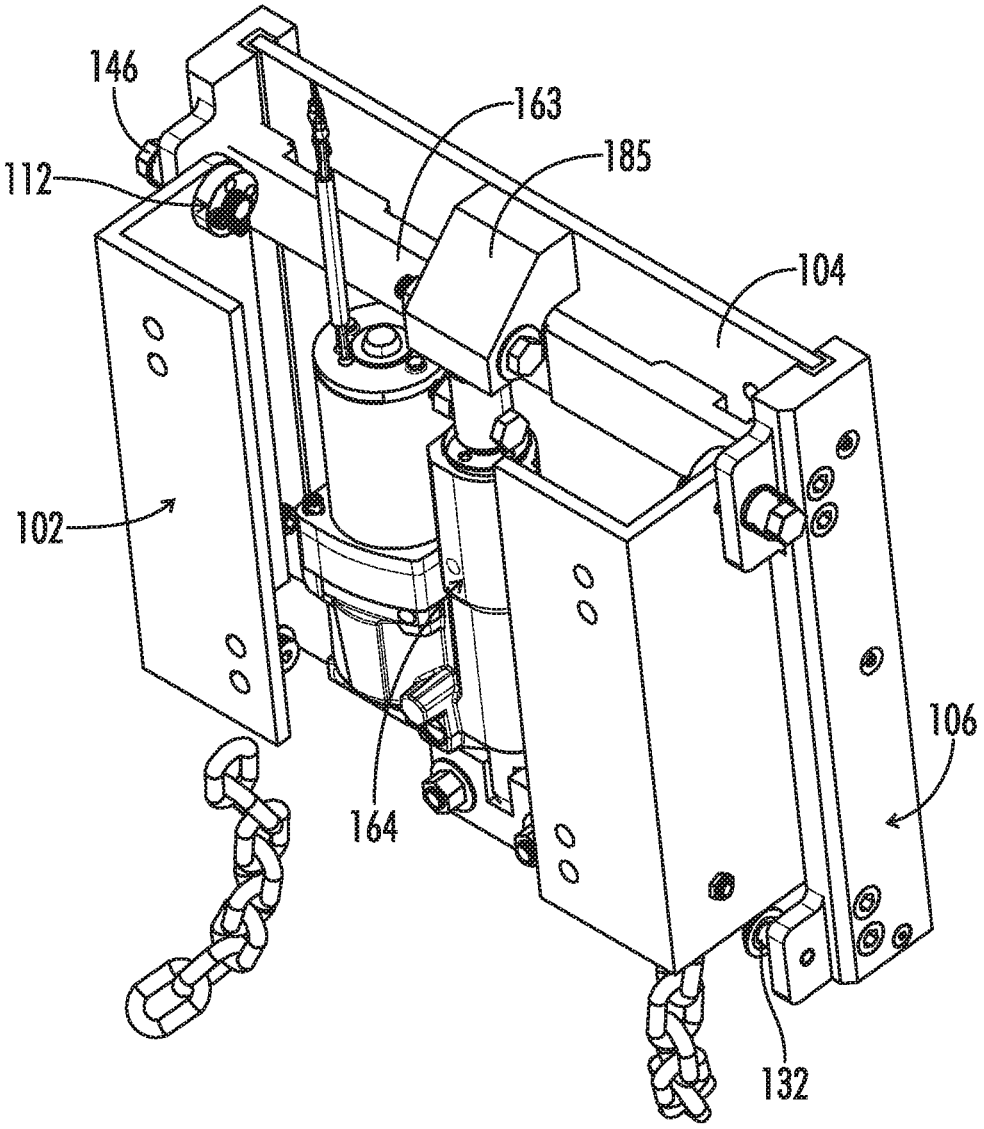
FIG. 6 is a front, top isometric port side view of the outboard mounting bracket of FIG. 1.
Figure 7:
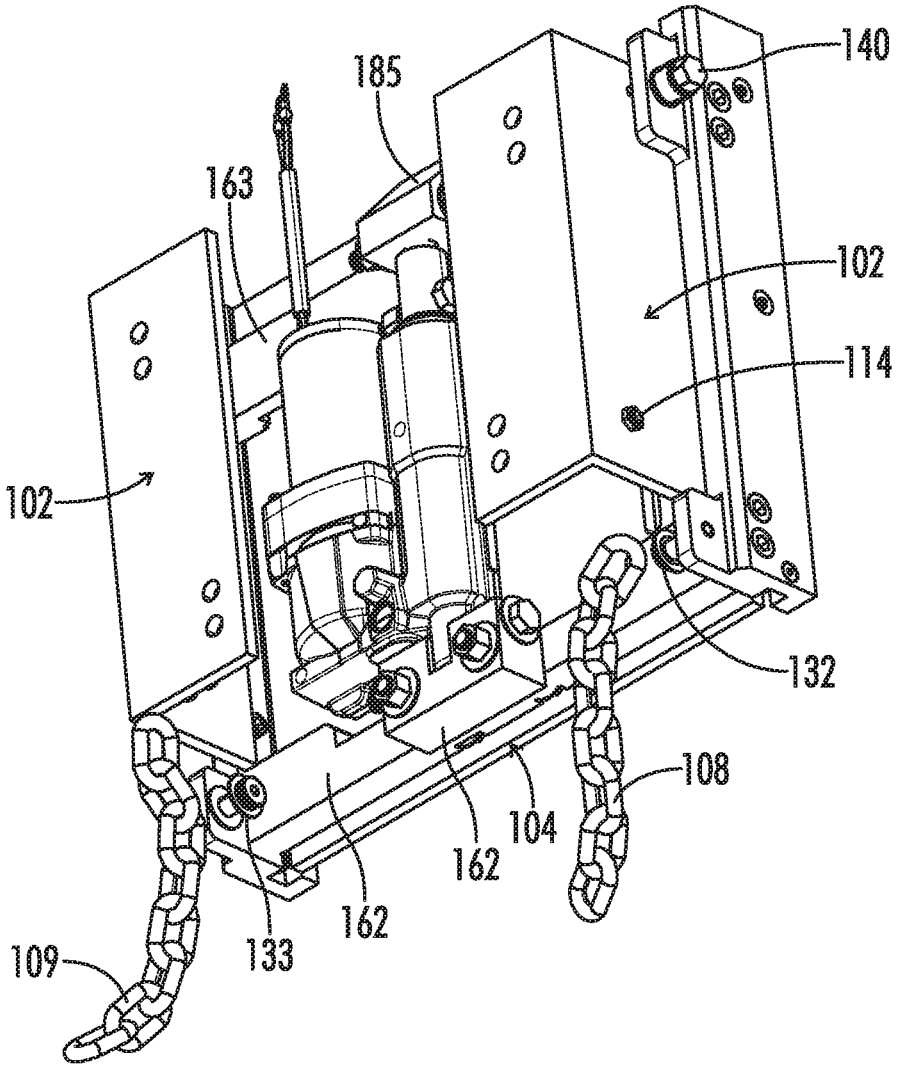
FIG. 7 is a front, bottom isometric port side view of the outboard mounting bracket of FIG. 1.
Figure 8:
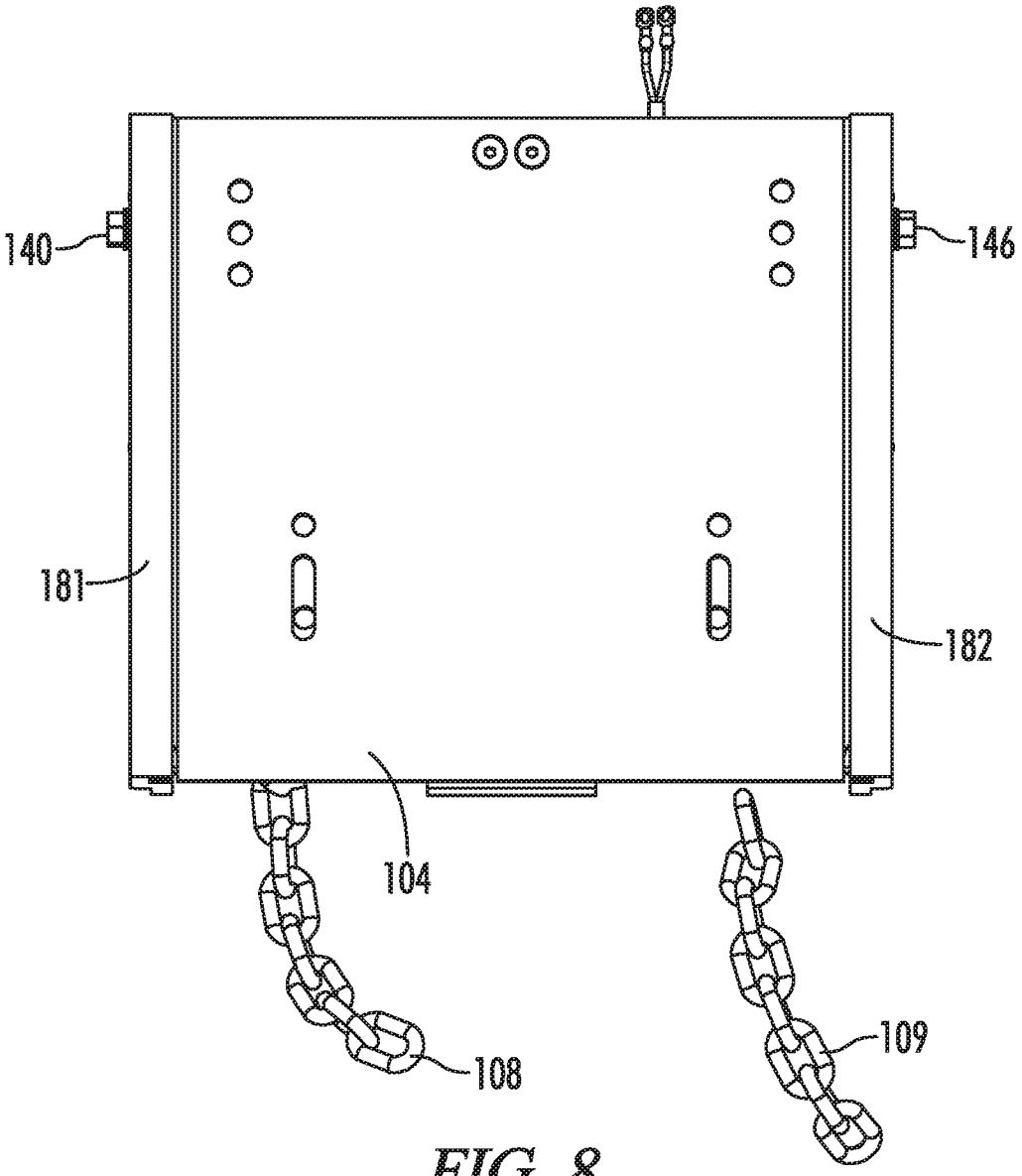
FIG. 8 is a rear perspective view of the outboard mounting bracket of FIG. 1.
Figure 9:
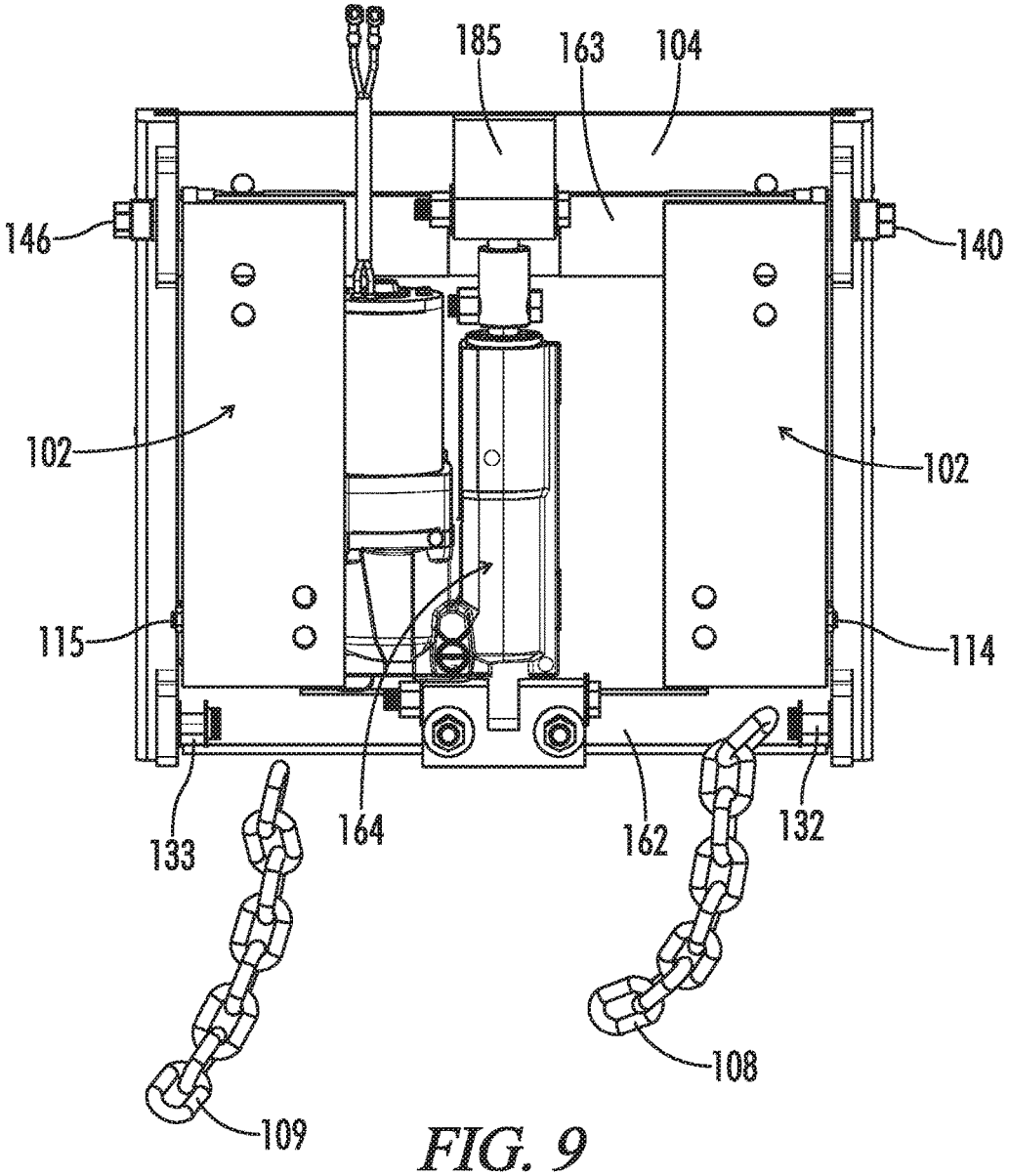
FIG. 9 is a front perspective view of the outboard mounting bracket of FIG. 1.
Figure 10:
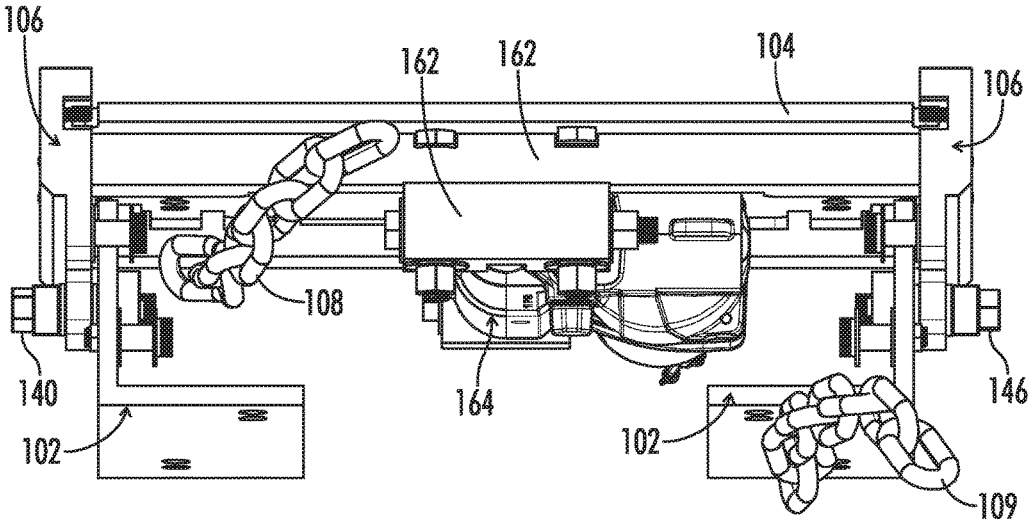
FIG. 10 is a bottom perspective view of the outboard mounting bracket of FIG. 1.
Figure 11:
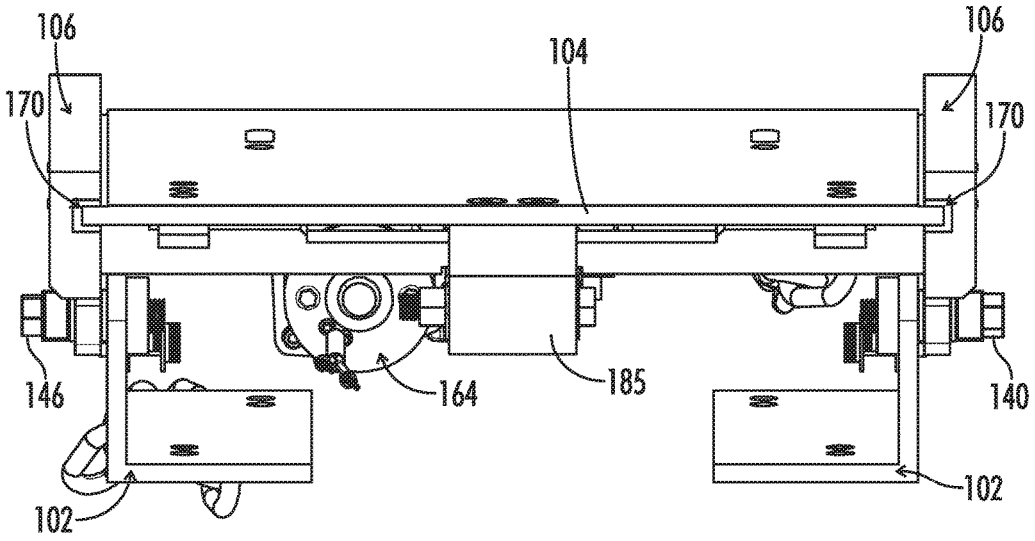
FIG. 11 is a top perspective view of the outboard mounting bracket of FIG. 1.

Referring to FIGS. 1-11, in one embodiment, an outboard motor mounting bracket 100 includes a hull mount 102, a motor plate 104, a jack assembly 106, and a limiting strap 108. The motor plate 104 is configured to support an outboard motor 120. The hull mount 102 is configured to mount to a boat hull 110. The hull mount 102 includes an upper attachment point 112 and a lower attachment point 114. In one embodiment, the hull mount 102 includes a port lower attachment point 114 and a starboard lower attachment point 115. In one embodiment, the hull mount 102 includes a port upper attachment point 112 and a star board upper attachment point 113.

The jack assembly 106 has an upper attachment point 130 and a lower attachment point 132. The upper attachment point 130 of the jack assembly 106 is configured to hingedly engage the upper attachment point 112 of the hull mount 102. The jack assembly 106 is configured to support the motor plate 104 and selectively adjust a vertical offset of the motor plate 104 relative to the upper attachment point 130 of the hull mount 106. In one embodiment, the jack assembly 106 includes a port lower attachment point 132 and a starboard lower attachment point 133.

In one embodiment, the jack assembly 106 includes a jack bracket 160, a lower crossmember 162, and a linear actuator 164. The jack bracket 160 includes a channel 170 therein configured to receive the motor plate 104 and maintain the motor plate 104 at a predetermined distance from the upper attachment point 130 of the jack assembly 106. The channel 170 extends generally vertically when the outboard motor mounting bracket 100 is in an upright and mounted position (i.e mounted to a plum transom and in the closed position). The linear actuator 164 is configured to connect to the lower crossmember 162 to the motor plate 104. The linear actuator 160 for selectively adjusts the vertical offset of the motor plate 104 relative to the jack bracket 106 by increasing or decreasing a length of the linear actuator 164. Increasing the length of the linear actuator 164 increases the vertical offset of the motor plate 104 (i.e., increases a height of the motor plate 104 and outboard motor mounted thereto), and decreasing the length of the linear actuator 164 decreases the vertical offset of the motor plate 104 (i.e., decreases a height of the motor plate 104 and outboard motor mounted thereto). In one embodiment, the motor plate 104 has a Ford side and an aft side. The Ford side is engraved or embossed with a scale 180 configured to indicate the vertical offset of the motor plate 104. In one embodiment, a user can determine the vertical offset of the motor plate 104 by determining numbers in the scale 180 visible above an upper crossmember 163 of the jack assembly 106. In one embodiment, the linear actuator 164 is a hydraulic ram, and in another embodiment, the linear actuator 164 is an integrated hydraulic ram an electronic pump assembly.

In one embodiment of the jack bracket 160, the jack bracket 160 includes a port portion 181 and a starboard portion 182. The channel 170 is formed by a vertically extending recess in a starboard face of the port portion 181 and a corresponding recess in a port face of the starboard portion 182. In one embodiment, the recess and corresponding recess are lined with a polymer insert 183. The lower crossmember 162 is configured to connect the port portion 181 of the jack bracket 162 the starboard portion 182 of the jack bracket 160. In one embodiment, the jack assembly 106 further includes an upper crossmember 163 configured to connect the port portion 181 of the jack bracket 162 the starboard portion 182 of the jack bracket 160 at a point on the jack bracket 160 above the lower crossmember 162. In one embodiment, the jack assembly further includes a mounting block 185 configured to connect to the motor plate 104 at a top of the motor plate 104. The linear actuator 164 connects the lower crossmember 162 to the mounting block 185 in order to connect the jack assembly 106 to the motor plate 104.

The limiting strap 108 is configured to connect the lower attachment point 114 of the hull mount 102 to the lower attachment point 132 of the jack assembly 106 such that the distance between the lower attachment point 114 of the hull mount 102 and the lower attachment point 132 of the jack assembly 106 is limited to a length of the limiting strap 108. In one embodiment, the limiting strap 108 is a port limiting strap 108, and the outboard mounting bracket 100 further includes a starboard limiting strap 109. The starboard limiting strap 109 connects the starboard lower attachment point 115 of the hull mount 102 to the starboard lower attachment point 133 of the jack assembly 106. In one embodiment, the limiting strap 108 is a length of stainless steel chain configured to limit an angle between the motor plate 104 and the transom 190 of the boat 110 to no more than 90°. In one embodiment, the angle between the transom 190 of the bow 110 and the motor plate 104 is limited by the limiting strap 108 to an angle of no more than 45°.

In one embodiment, the outboard mounting bracket 100 further includes a tensioner assembly 140. The tensioner assembly 140 is configured to connect the upper attachment point 112 of the hull mount 102 to the upper attachment point 130 of the jack assembly 106. In one embodiment, the upper attachment point 112 of the hull mount 102 is a hole through a longitudinally extending ear 150 of the hull mount 102. The longitudinally extending ear 150 of the hull mount 102 may extend along all or just a portion of the vertical length of the hull mount 102. In one embodiment, the upper attachment point 130 of the jack assembly 106 is a hole through a longitudinally extending ear 152 of the jack assembly 106 corresponding to the hole through the longitudinally extending ear 150 of the hull mount 102. The longitudinally extending ear 152 of the jack assembly 106 may extend along all or just a portion of the vertical length of the jack assembly 106. In one embodiment, the tensioner assembly 140 is configured to extend through the hole in the hull mount 102 and through the corresponding hole in the jack assembly 106 to hingedly connect the hull mount 102 to the jack assembly 106 and squeeze the longitudinally extending ear 150 of the hull mount 102 against the longitudinally extending ear 152 of the jack assembly 106. In one embodiment, the tensioner assembly 140 includes a tensioner knob, a tensioner nut threateningly engaging the tensioner knob, and a bronze washer located between the tensioner nut and longitudinally extending ear 150 of the hull mount 102 or the longitudinally extending ear 152 of the jack assembly 106. In one embodiment, the tensioner assembly 140 is a port tensioner assembly 140 and the outboard motor mounting bracket 100 further includes a star board tensioner assembly 146.

In one embodiment, a boat includes a boat hull 110 and an outboard motor mounting bracket 100. The outboard mounting bracket 100 may be integral with the transom 190 of the boat hull 110 (i.e., cast formed or welded thereto) or bolted to the transom 190. In one embodiment, the boat further includes an outboard motor 120.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful OUTBOARD ENGINE KICK-UP JACKING PLATE it is not intended that such references be construed as limitations upon the scope of this invention except as set forth in the following claims.

What is claimed is:

1. An outboard motor mounting bracket comprising:

a hull mount configured to mount to a boat hull, said hull mount having an upper attachment point and a lower attachment point;

a motor plate configured to support an outboard motor;

a jack assembly having an upper attachment point and a lower attachment point, wherein:

the upper attachment point of the jack assembly is configured to hingedly engage the upper attachment point of the hull mount; and the jack assembly is configured to support the motor plate and selectively adjust a vertical offset of the motor plate relative to the jack assembly; and a limiting strap configured to connect the lower attachment point of the hull mount to the lower attachment point of the jack assembly such that a distance between the lower attachment point of the hull mount and the lower attachment point of the jack assembly is limited to a length of the limiting strap.

2. The outboard motor mounting bracket of claim 1, further comprising:

a tensioner assembly configured to connect the upper attachment point of the hull mount to the upper attachment point of the jack assembly, wherein:

the upper attachment point of the hull mount is a hole through a longitudinally extending ear of the hull mount;

the upper attachment point of the jack assembly is a hole through a longitudinally extending ear of the jack assembly corresponding to the hole through the longitudinally extending ear of the hull mount; and the tensioner assembly is configured to extend through the hole in the hull mount and through the corresponding hole in the jack assembly to hingedly connect the hull mount to the jack assembly and squeeze the longitudinally extending ear of the hull mount against the longitudinally extending ear of the jack assembly.

3. The outboard motor mounting bracket of claim 1, further comprising:

a tensioner assembly configured to connect the upper attachment point of the hull mount to the upper attachment point of the jack assembly, wherein:

the upper attachment point of the hull mount is a hole through a longitudinally extending ear of the hull mount;

the upper attachment point of the jack assembly is a hole through a longitudinally extending ear of the jack assembly corresponding to the hole through the longitudinally extending ear of the hull mount; and the tensioner assembly is configured to extend through the hole in the hull mount and through the corresponding hole in the jack assembly to hingedly connect the hull mount to the jack assembly and provide squeeze the longitudinally extending ear of the hull mount against the longitudinally extending ear of the jack assembly; wherein:

the tensioner assembly is a port tensioner assembly; and the outboard motor mounting bracket further comprises a starboard tensioner assembly.

4. The outboard motor mounting bracket of claim 1, wherein:

the hull mount comprises a port lower attachment point and a starboard lower attachment point;

the jack assembly comprises a port lower attachment point and a starboard lower attachment point;

the limiting strap is a port limiting strap connecting the port lower attachment point of the hull mount to the port lower attachment point of the jack assembly; and the outboard mounting bracket further comprises a starboard limiting strap connecting the starboard lower attachment point of the hull mount to the starboard lower attachment point of the jack assembly.

5. The outboard motor mounting bracket of claim 1, wherein the jack assembly comprises:

a jack bracket, wherein said jack bracket has a channel therein configured to receive the motor plate and maintain the motor plate at a predetermined distance from the upper attachment point of the jack assembly, said channel extending generally vertically when the outboard motor mounting bracket is in an upright position;

a lower crossmember; and a linear actuator configured to connect the lower crossmember to the motor plate, and to selectively adjust a vertical offset of the motor plate relative to the jack bracket, wherein increasing a length of the linear actuator increases the vertical offset of the motor plate and decreasing the length of the linear actuator decreases the vertical offset of the motor plate.

6. The outboard motor mounting bracket of claim 1, wherein the jack assembly comprises:

a jack bracket, wherein said jack bracket has a channel therein configured to receive the motor plate and maintain the motor plate at a predetermined distance from the upper attachment point of the jack assembly, said channel extending generally vertically when the outboard motor mounting bracket is in an upright position;

a lower crossmember; and a linear actuator configured to connect the lower crossmember to the motor plate, and to selectively adjust a vertical offset of the motor plate relative to the jack bracket, wherein increasing a length of the linear actuator increases the vertical offset of the motor plate and decreasing the length of the linear actuator decreases the vertical offset of the motor plate; wherein the motor plate has a forward side and an aft side, and the forward side is engraved or embossed with a scale configured to indicate the vertical offset of the motor plate.

7. The outboard motor mounting bracket of claim 1, wherein the jack assembly comprises:

a jack bracket, wherein said jack bracket has a channel therein configured to receive the motor plate and maintain the motor plate at a predetermined distance from the upper attachment point of the jack assembly, said channel extending generally vertically when the outboard motor mounting bracket is in an upright position;

a lower crossmember; and a linear actuator configured to connect the lower crossmember to the motor plate, and to selectively adjust a vertical offset of the motor plate relative to the jack bracket, wherein increasing a length of the linear actuator increases the vertical offset of the motor plate and decreasing the length of the linear actuator decreases the vertical offset of the motor plate; wherein the linear actuator is a hydraulic ram.

8. The outboard motor mounting bracket of claim 1, wherein the jack assembly comprises:

a jack bracket, wherein said jack bracket has a channel therein configured to receive the motor plate and maintain the motor plate at a predetermined distance from the upper attachment point of the jack assembly, said channel extending generally vertically when the outboard motor mounting bracket is in an upright position;

a lower crossmember; and a linear actuator configured to connect the lower crossmember to the motor plate, and to selectively adjust a vertical offset of the motor plate relative to the jack bracket, wherein increasing a length of the linear actuator increases the vertical offset of the motor plate and decreasing the length of the linear actuator decreases the vertical offset of the motor plate; wherein the linear actuator is an integrated hydraulic ram and electric pump assembly.

9. The outboard motor mounting bracket of claim 1, wherein the jack assembly comprises:

a jack bracket, wherein said jack bracket has a channel therein configured to receive the motor plate and maintain the motor plate at a predetermined distance from the upper attachment point of the jack assembly, said channel extending generally vertically when the outboard motor mounting bracket is in an upright position, wherein said jack bracket comprises a port portion and a starboard portion and the channel is formed by a vertically extending recess in a starboard face of the port portion and a corresponding recess in a port face of the starboard portion, and wherein said recess and corresponding recess are lined with a polymer insert;

a lower crossmember configured to connect the port portion of the jack bracket to the starboard portion of the jack bracket;

an upper crossmember configured to connect the port portion of the jack bracket to the starboard portion of the jack bracket at a point on the jack bracket above the lower crossmember;

a mounting block configured to connect to the motor plate at a top of the motor plate; and a linear actuator configured to connect the lower crossmember to mounting block, and to selectively adjust a vertical offset of the motor plate relative to the jack bracket, wherein increasing a length of the linear actuator increases the vertical offset of the motor plate and decreasing the length of the linear actuator decreases the vertical offset of the motor plate; wherein the linear actuator is a hydraulic ram.

10. The outboard motor mounting bracket of claim 1, wherein the limiting strap comprises a length of stainless steel chain configured to limit an angle between the motor plate and the transom of the boat to no more than 90 degrees.

11. A boat comprising:

a boat hull; and an outboard motor mounting bracket, said outboard motor bracket comprising:

a hull mount configured to mount to a boat hull, said hull mount having an upper attachment point and a lower attachment point;

a motor plate configured to support an outboard motor;

a jack assembly having an upper attachment point and a lower attachment point, wherein:

the upper attachment point of the jack assembly is configured to hingedly engage the upper attachment point of the hull mount; and the jack assembly is configured to support the motor plate and selectively adjust a vertical offset of the motor plate relative to the jack assembly; and a limiting strap configured to connect the lower attachment point of the hull mount to the lower attachment point of the jack assembly such that a distance between the lower attachment point of the hull mount and the lower attachment point of the jack assembly is limited to a length of the limiting strap.

12. The boat of claim 11, wherein the outboard motor mounting bracket further comprises:

a tensioner assembly configured to connect the upper attachment point of the hull mount to the upper attachment point of the jack assembly, wherein:

the upper attachment point of the hull mount is a hole through a longitudinally extending ear of the hull mount;

the upper attachment point of the jack assembly is a hole through a longitudinally extending ear of the jack assembly corresponding to the hole through the longitudinally extending ear of the hull mount; and the tensioner assembly is configured to extend through the hole in the hull mount and through the corresponding hole in the jack assembly to hingedly connect the hull mount to the jack assembly and squeeze the longitudinally extending ear of the hull mount against the longitudinally extending ear of the jack assembly.

13. The boat of claim 11, wherein the outboard motor mounting bracket further comprises:

a tensioner assembly configured to connect the upper attachment point of the hull mount to the upper attachment point of the jack assembly, wherein:

the upper attachment point of the hull mount is a hole through a longitudinally extending ear of the hull mount;

the upper attachment point of the jack assembly is a hole through a longitudinally extending ear of the jack assembly corresponding to the hole through the longitudinally extending ear of the hull mount; and the tensioner assembly is configured to extend through the hole in the hull mount and through the corresponding hole in the jack assembly to hingedly connect the hull mount to the jack assembly and provide squeeze the longitudinally extending ear of the hull mount against the longitudinally extending ear of the jack assembly; wherein:

the tensioner assembly is a port tensioner assembly; and the outboard motor mounting bracket further comprises a starboard tensioner assembly.

14. The boat of claim 11, wherein:

the hull mount comprises a port lower attachment point and a starboard lower attachment point;

the jack assembly comprises a port lower attachment point and a starboard lower attachment point;

the limiting strap is a port limiting strap connecting the port lower attachment point of the hull mount to the port lower attachment point of the jack assembly; and the outboard mounting bracket further comprises a starboard limiting strap connecting the starboard lower attachment point of the hull mount to the starboard lower attachment point of the jack assembly.

15. The boat of claim 11, wherein the jack assembly comprises:

a jack bracket, wherein said jack bracket has a channel therein configured to receive the motor plate and maintain the motor plate at a predetermined distance from the upper attachment point of the jack assembly, said channel extending generally vertically when the outboard motor mounting bracket is in an upright position;

a lower crossmember; and a linear actuator configured to connect the lower crossmember to the motor plate, and to selectively adjust a vertical offset of the motor plate relative to the jack bracket, wherein increasing a length of the linear actuator increases the vertical offset of the motor plate and decreasing the length of the linear actuator decreases the vertical offset of the motor plate.

16. The boat of claim 11, wherein the jack assembly comprises:

a jack bracket, wherein said jack bracket has a channel therein configured to receive the motor plate and maintain the motor plate at a predetermined distance from the upper attachment point of the jack assembly, said channel extending generally vertically when the outboard motor mounting bracket is in an upright position;

a lower crossmember; and a linear actuator configured to connect the lower crossmember to the motor plate, and to selectively adjust a vertical offset of the motor plate relative to the jack bracket, wherein increasing a length of the linear actuator increases the vertical offset of the motor plate and decreasing the length of the linear actuator decreases the vertical offset of the motor plate; wherein the motor plate has a forward side and an aft side, and the forward side is engraved or embossed with a scale configured to indicate the vertical offset of the motor plate.

17. The boat of claim 11, wherein the jack assembly comprises:

a jack bracket, wherein said jack bracket has a channel therein configured to receive the motor plate and maintain the motor plate at a predetermined distance from the upper attachment point of the jack assembly, said channel extending generally vertically when the outboard motor mounting bracket is in an upright position;

a lower crossmember; and a linear actuator configured to connect the lower crossmember to the motor plate, and to selectively adjust a vertical offset of the motor plate relative to the jack bracket, wherein increasing a length of the linear actuator increases the vertical offset of the motor plate and decreasing the length of the linear actuator decreases the vertical offset of the motor plate; wherein the linear actuator is a hydraulic ram.

18. The boat of claim 11, wherein the jack assembly comprises:

a jack bracket, wherein said jack bracket has a channel therein configured to receive the motor plate and maintain the motor plate at a predetermined distance from the upper attachment point of the jack assembly, said channel extending generally vertically when the outboard motor mounting bracket is in an upright position;

a lower crossmember; and a linear actuator configured to connect the lower crossmember to the motor plate, and to selectively adjust a vertical offset of the motor plate relative to the jack bracket, wherein increasing a length of the linear actuator increases the vertical offset of the motor plate and decreasing the length of the linear actuator decreases the vertical offset of the motor plate; wherein the linear actuator is an integrated hydraulic ram and electric pump assembly.

19. The boat of claim 11, wherein the jack assembly comprises:

a jack bracket, wherein said jack bracket has a channel therein configured to receive the motor plate and maintain the motor plate at a predetermined distance from the upper attachment point of the jack assembly, said channel extending generally vertically when the outboard motor mounting bracket is in an upright position, wherein said jack bracket comprises a port portion and a starboard portion and the channel is formed by a vertically extending recess in a starboard face of the port portion and a corresponding recess in a port face of the starboard portion, and wherein said recess and corresponding recess are lined with a polymer insert;

a lower crossmember configured to connect the port portion of the jack bracket to the starboard portion of the jack bracket;

an upper crossmember configured to connect the port portion of the jack bracket to the starboard portion of the jack bracket at a point on the jack bracket above the lower crossmember;

a mounting block configured to connect to the motor plate at a top of the motor plate; and a linear actuator configured to connect the lower crossmember to mounting block, and to selectively adjust a vertical offset of the motor plate relative to the jack bracket, wherein increasing a length of the linear actuator increases the vertical offset of the motor plate and decreasing the length of the linear actuator decreases the vertical offset of the motor plate; wherein the linear actuator is a hydraulic ram.

20. The boat of claim 11, wherein the limiting strap comprises a length of stainless steel chain configured to limit an angle between the motor plate and the transom of the boat to no more than 90 degrees.

* * * * *